United States Patent [19]

McCain

[11] Patent Number: 4,819,905

[45] Date of Patent: Apr. 11, 1989

[54] TROLLING MOTOR MOUNT FOR PLEASURE BOATS

[76] Inventor: Conrad L. McCain, 613 S. First St., Atwood, Kans. 67730

[21] Appl. No.: 140,545

[22] Filed: Jan. 4, 1988

[51] Int. Cl.[4] ..... F16M 13/00

[52] U.S. Cl. ..... 248/642; 114/364; 440/6

[58] Field of Search ..... 248/640, 641, 642, 643; 440/6, 63; 114/364; 403/100, 102; 256/25, 26; 24/2.5

[56] References Cited

U.S. PATENT DOCUMENTS

| | | | |
|---|---|---|---|
| 747,801 | 12/1903 | Sturges | 440/63 |
| 2,475,889 | 7/1949 | Hafele | 248/641 |
| 3,918,666 | 11/1975 | Florian | 248/641 |
| 3,941,072 | 3/1976 | Caton et al. | 248/642 X |
| 4,338,875 | 7/1982 | Lisowski | 114/364 |
| 4,505,012 | 3/1985 | Johnson | 24/2.5 X |
| 4,611,552 | 9/1986 | Koppelomaki | 114/362 X |
| 4,698,032 | 10/1987 | Hill | 440/6 |

*Primary Examiner*—Alvin C. Chin-Shue
*Assistant Examiner*—David L. Talbott
*Attorney, Agent, or Firm*—James E. Pittenger

[57] ABSTRACT

An adjustable bracket mounting support for mounting an electric trolling motor on the forward end of a pleasure boat which includes a base member supported by two adjustable length arms which are attached to slidable clamps mounted on the bow rails of the boat and a downwardly extending support leg which attaches to the bow eye of the boat. A motor mount plate is rotatably mounted on the base plate and is adapted for receiving the mounting bracket assembly of a remotely controlled electric trolling motor. The supporting arm and legs of the mount are of the telescoping type which allows an infinite amount of length adjustment to properly position the motor mount as desired either over or beyond the front edge of the boat. Slidably adjustable clamps are provided for attachment of the arms to the bow rails of the boat so that alignment and adjustment of the supporting arms can be provided.

12 Claims, 3 Drawing Sheets

TROLLING MOTOR MOUNT FOR PLEASURE BOATS

FIELD OF THE INVENTION

This invention relates to a portable bracket for mounting a trolling motor on the bow of a boat. It is more specifically directed to a mounting bracket for adjustably mounting an electric trolling motor on the bow of a pleasure boat.

BACKGROUND OF THE INVENTION

As is well known many people today own pleasure boats which have high powered motors that are ideal for water skiing as well as high speed cruising across large and small bodies of water. Many of these boats are propelled by inboard engines, outboard engines or inboard/outboard engines and have V or Tri-Hull type construction. With this hull configuration, they are capable of maneuvering at their intended high speeds, but this power and design becomes very inefficient at slow speeds.

In addition, most persons can only afford to own one boat at a time and it is desirable to be able to utilize these boats for other purposes, such as fishing. Fishing, however, requires very slow speeds and maneuverability. Because of the size of the engine usually found in pleasure boats it is nearly impossible or at least very inefficient to try to move these boats for fishing and trolling by using the boat's existing engine or motor.

In the past, various devices have been attached to the power unit of the motor directly behind the propeller to disturb the water flow from the propeller and substantially negate the thrust of the propeller in order to make the boat move slowly through the water. Naturally, this type of usage for a large motor and a propeller is rather cumbersome and produces problems and undesirable conditions.

Other proposed answers to this problem have been to mount a small secondary outboard motor on the transom of the boat and use this motor for trolling when slow speed is desired. It has been found in many cases that this is a very expensive proposition in that a complete second outboard motor, usually gasoline powered, is required. This type of motor also requires a separate gas tank stored on the boat and connected by a fuel line directly to the auxiliary engine. This not only creates a messy appearance but also produces a fire hazard because the gasoline is usually stored in a relatively open area at the stern of the boat. This area is usually where many people congregate or desire to fish and therefore, produces a totally undesirable condition.

Another problem that exists with mounting a secondary or auxiliary outboard motor on the transom of the boat is that the motor must be offset from the centerline of the boat because of the positioning of the primary motor or propulsion unit. In addition, because of the fact that the secondary outboard motor is usually cantilevered beyond the rear of the transom it is difficult to reach and steer the motor. For this reason, in some cases, a tie-bar is used to tie the secondary outboard motor to the primary steering mechanism of the boat. Although this arrangement can be extremely cumbersome, it helps to alleviate some of the problem. This does not, however, make it any easier to control the speed of the secondary motor since the controls on this motor are usually mechanical and any adjustments must be made at the motor itself.

Trolling motors, especially electrically powered trolling motors, have been well known in recent years. These motors are very easy to handle and only require the addition of a relatively safe electrical power source such as a battery. In addition, these motors although of relatively low power can be quite efficient and quiet in maneuvering and controlling a boat while fishing. In fact, these motors are commonly used on the front of small flat bottomed fishing boats, sometimes called "bass boats". This type of propulsion in addition to being quiet and efficient can have foot operated controls to actually operate the motor remotely by foot movement so that the fisherman can use his hands for other purposes such as casting and landing fish.

Up to now there has been no good way of combining the advantages of a fishing boat and the electric trolling motor to the high powered pleasure boat. For this reason, the present invention provides a novel arrangement for combining the advantages of the electric trolling motor with the high powered pleasure boat to allow the owner the benefit of being able to use his boat for multiple purposes.

INFORMATION DISCLOSURE STATEMENT

The applicant is aware of his duty to disclose to the Patent Office all information which is believed to be material to the examination of this application. In accordance with his duty the applicant hereby states that he is unaware of any issued patents or prior art which are material or pertinent to the examination of this application at this time.

SUMMARY OF THE INVENTION

This invention is directed to a portable and removable mounting bracket which can be mounted on the bow of a pleasure type motor boat so that an electric trolling motor can be easily mounted on the boat and controlled. It is common on practically all pleasure boats to provide a pair of bow rails around the bow or forward deck portion of a pleasure boat. In addition, some of these boats also leave the bow area open or depressed to allow occupants to be seated in this area while the boat is in operation. This type of arrangement lends itself to using the pleasure boat for fishing purposes when modified with the present invention.

The mounting bracket according to the present invention includes a mounting plate which is pivotally mounted on the top of a centrally positioned base plate. The base plate is supported in a suspended position over the bow of the boat by means of a support leg which extends down in front of the boat and attaches to the bow eye which is found on all boats. At the same time, the central base plate is horizontally positioned and supported by two adjustable length arms which extend across the top deck of the boat and are positionally attached to the bow rails. Slidable clamps on the bow rails allow the support arms to be properly adjusted to position the base plate in a desirable position along the front portion of the boat and allow the arms to be attached or removed quickly.

The rotatable mounting plate which is mounted on the base plate is universally sized and arranged to receive the base mount of an electric trolling motor. Usually, this is the type of motor mount which has a linkage arrangement which can be pivoted rearwardly to allow the entire motor and shaft to be elevated into a horizontal resting position on the top of the base mount. In this way the trolling motor can be elevated and removed from the water so as to not present a hazard during the normal operation of the boat.

Once the desired location has been reached, the main propulsion motor is shut down and the electric trolling motor is pivotally moved into the vertical position wherein the head of the motor is submerged below the surface of the water. Suitable adjustments are provided on the motor and its mount to allow for proper positioning of the motor. It is anticipated that the foot operated, remote control electric trolling motor will be used with this invention. In this way, an elevated fishing seat can be mounted on the deck or in the open bow of the pleasure boat with the foot control within easy access for controlling the motor movement and speed and thus, the position of the boat.

The motor mount according to the present invention includes a number of telescoping leg and arm members which allow the motor mount to be precisely positioned and horizontally mounted. In this way the motor shaft can be arranged to extend vertically down into the water to provide the best power efficiency and control for the boat. Adjustable clamps are provided for attachment to the bow rails of the boat with the support arms quick connected to these clamps in a universal joint arrangement to correct any misalignment. The mounting plate for the electric trolling motor is rotatably mounted at its forward end to the base plate so that the torque placed on the motor mount will not cause the mount to pivot or move during use.

Other features and advantages of the present invention will become apparent from the following detailed description of the invention when considered in conjunction with the accompanying drawings.

DETAILED DESCRIPTION OF THE INVENTION

Figure 1:
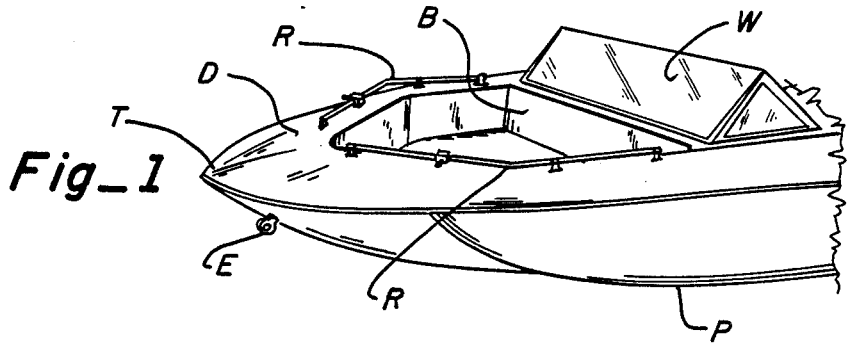
FIG. 1 shows a perspective pictorial view of an open bow type pleasure boat.

Turning now more specifically to the drawings, FIG. 1 shows a pleasure boat which may or may not have the open bow configuration. As shown in FIG. 1 the open bow configuration allows the positioning of a seat to be mounted in the middle of the open area. In this way, the fisherman has a clear view and free access to cast in any direction. This arrangement lends itself to effective use of the trolling motor mount which is the subject of this invention.

The pleasure boat P includes windshield W, open bow area B, as well as bow eye E and bow rails R. A boat having these features lends itself very readily to the invention which is shown and described in this application.

Figure 2:
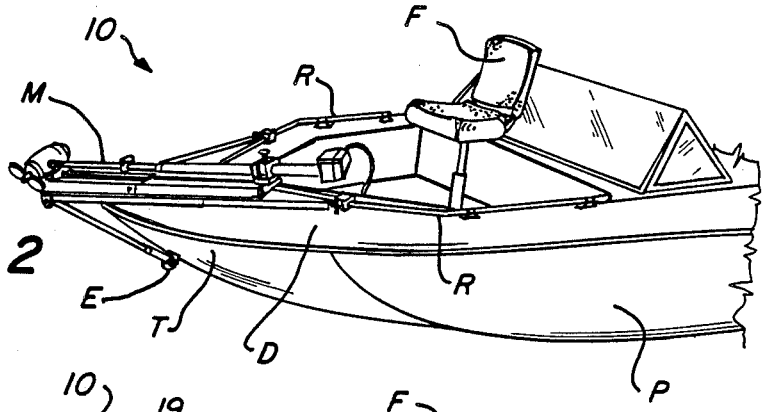
FIG. 2 shows the trolling motor mounting bracket and motor along with fishing seat mounted on the pleasure boat of FIG. 1.

FIG. 2 shows the same boat P as seen in FIG. 1 with the addition of the fishermen's seat F which is mounted on the deck portion of the open bow area B. The trolling motor mount or bracket 10 shows the electric trolling motor M mounted on the top portion of the mount 10.

Figure 3:
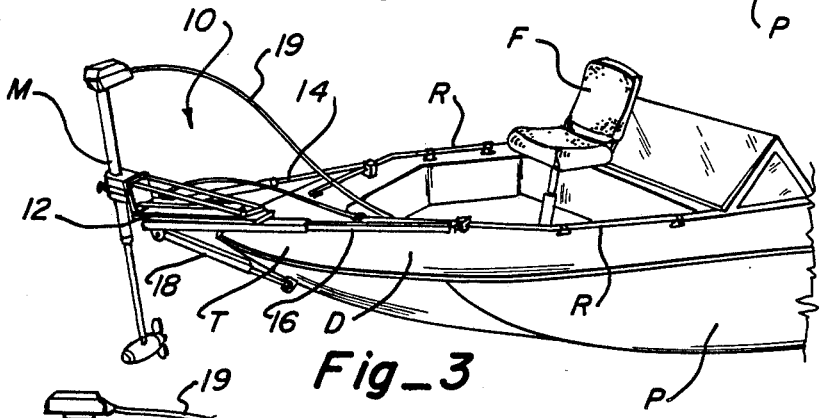
FIG. 3 shows the trolling motor and mount extended to the vertical operating position for controlling the speed and direction of the pleasure boat.

In FIG. 3, the trolling motor mount 10 includes base platform 12 which is suspended over the bow T of the boat P by means of adjustable arms 14, 16 and support leg 18. In FIG. 2 the motor M is shown in a reclining or storage position while in FIG. 3 the motor is extended and positioned in the water for propelling the boat slowly while fishing. An electric cable 19 can extend from the top portion of the control head of the motor M with a remote foot control positioned on the deck within the open bow area B whereby the fisherman can control the movement of the motor and therefore, the boat by his foot. Thus, the user's arms and hands are left free for casting bait and landing the fish.

Throughout this application a reference will be made to the use of an electric trolling motor for the purpose of moving the boat slowly through the water. Although reference will be made to a remote controlled type trolling motor, it is to be understood that any type of electrical trolling motor can be used with the present invention to provide a substantial advantage.

Figure 4:
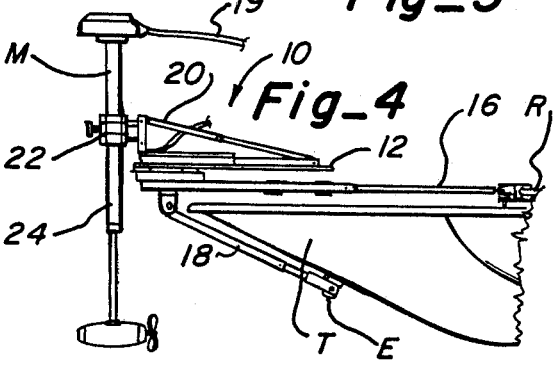
FIG. 4 is a side elevational view of the forward portion of the boat showing the mounting bracket and the trolling motor mounted thereon.
Figure 5:
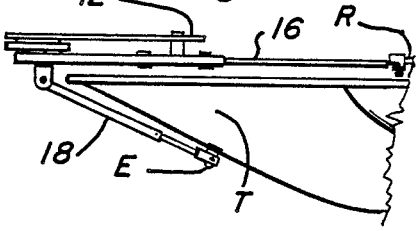
FIG. 5 is a side elevational view of the mounting bracket separately attached to the bow of the boat.

FIGS. 4 and 5 show the motor having a mounting bracket 20 and collar 22 adjustably positioned on the shaft 24 of the motor. The motor mount bracket 20 which includes a retractable linkage is removably mounted by suitable fasteners to the mounting assembly 12 of the motor mount according to the present invention. In FIG. 5 the mounting assembly 12 is seen arranged in a horizontal position with the arms 14, 16 extending rearwardly and fastened to the bow rails R by suitable clamps. The forward end of the mounting assembly 12 is supported by the leg 18 which is attached to the bow eye E of the boat. By adjustably positioning the leg 18 and the arms 14, 16 the mounting assembly 12 can be properly positioned over the bow T of the deck D of the boat. It is important to position the assembly 12 in a horizontal position so that the motor shaft will extend vertically into the water to provide the proper position for operation.

Figure 6:
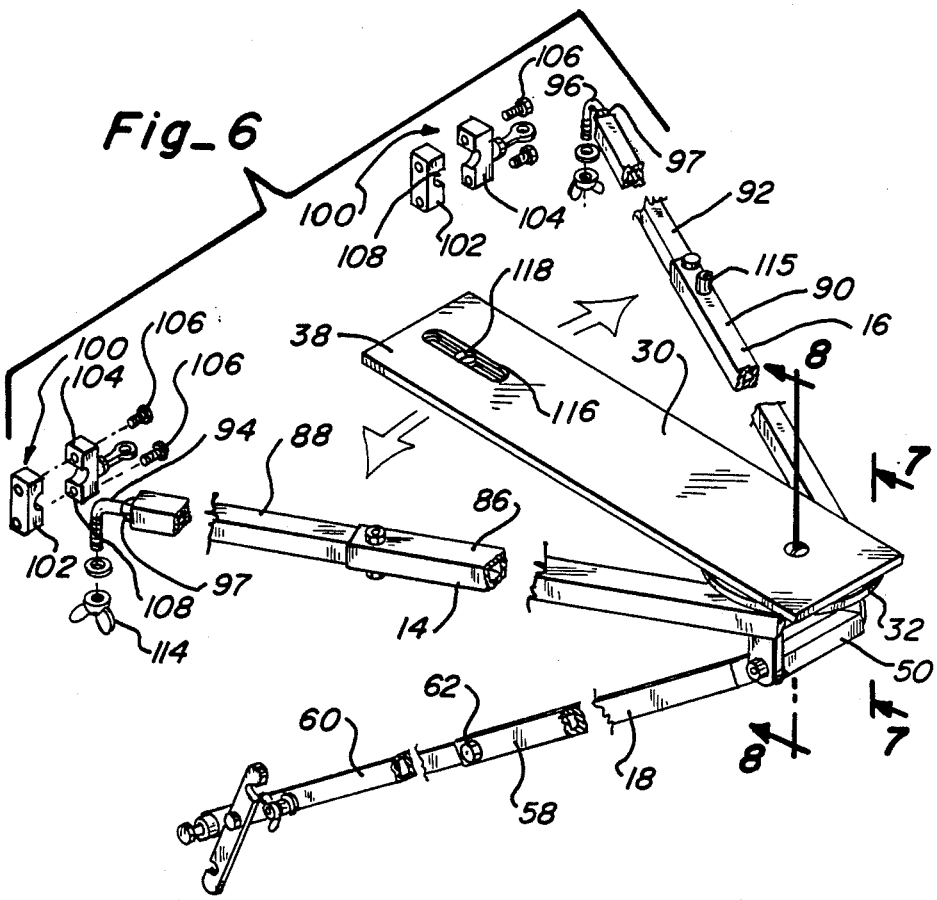
FIG. 6 is an perspective exploded view of the mounting bracket according to the present invention.
Figure 7:
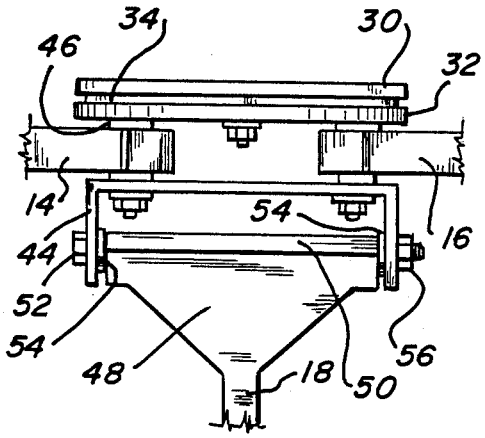
FIG. 7 is a partial front view of the mounting bracket showing the pivotal attachments for the support leg and arms taken along lines 7—7 of FIG. 6.
Figure 8:
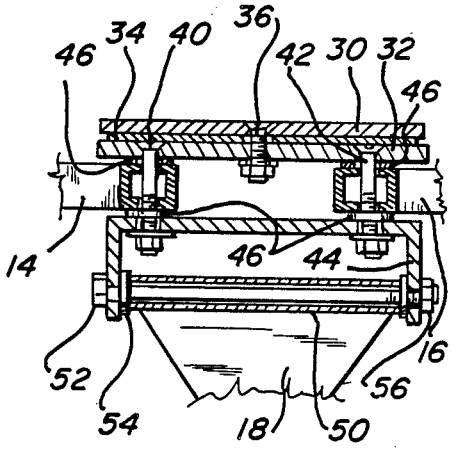
FIG. 8 is a partial cross sectional view taken along lines 8—8 of FIG. 6.

As shown in FIGS. 6–8 the mounting assembly 12 includes a flat mounting plate 30 which is pivotally mounted to a base plate 32 by a suitable flat head bolt, nut and washer assembly 36. The hole which is provided for the bolt 36 is essentially centered in the base plate 32. A suitable flat spacer 34 is provided between the mounting plate 30 and the base plate 32 to reduce the coefficient of friction between these plates and to allow the opposite end 38 of the mounting plate 30 to be easily moved either to the right or left with respect to the bow of the boat. The spacer material 34 can be any suitable material such as Nylon, Teflon, Kel-F or even paper.

The base plate 32 is supported by pivot attachments provided at the ends of the arms 14, 16 and leg 18. Lateral, equally spaced counter sunk holes are drilled in the base plate 32 opposite the position of the bolt assembly 36. Flat head bolts 40, 42 pass downwardly through the base plate holes and through holes provided in the ends of the arms 14, 16 and U-shaped clevis 44. A washer and nut is provided on the end of the bolts 40, 42 to secure the assembly. Suitable washers 46 are provided in the bolt assemblies between the base plate 32, arms 14, 16 and clevis 44. These washers can be made from soft metal, or suitable plastics to allow the arms 14, 16 to pivot easily on the bolts 40, 42, respectively.

The upper end 48 of leg 18 is flared to provide a substantially wider dimension with the end rolled so as to form a hollow cylindrical section 50. It is also possible during the manufacture of this part that instead of rolling the material forming the upper end 48 it is also possible to weld a tubular cylinder on this end to provide the same function. A suitable bolt 52 is inserted through aligned holes provided in the ends of clevis 44 and through the tubular section 50 of the leg 18. Spacer washers 54 are provided on each end of the tubular section 50 to permit the pivotal action of the leg 18 with respect to the clevis 44. The bolt 52 is held in place by a suitable nut 56.

Since each boat style and type can be different and the distance between the bow eye E and the desired position of the mounting plate 30 can be different, the support leg 18 is arranged to be adjustable in length. As illustrated in FIG. 6, leg 18 is composed of two square hollow tubular members 58, 60 which are sized so as to slidably interfit in a telescoping configuration. Once the proper length of the leg 18 has been determined a hole can be drilled through member 60 and a bolt 62 can be inserted so as to hold the two members in proper relationship. It is also possible to provide a pair of aligned holes in the end of the member 58 and a series of equally spaced holes in member 60 with the two members held in proper position by means of a releasable pin. In this way, the length of leg 18 can be varied if the mounting assembly is intended to be used on a number of different pleasure boats.

Figure 10:
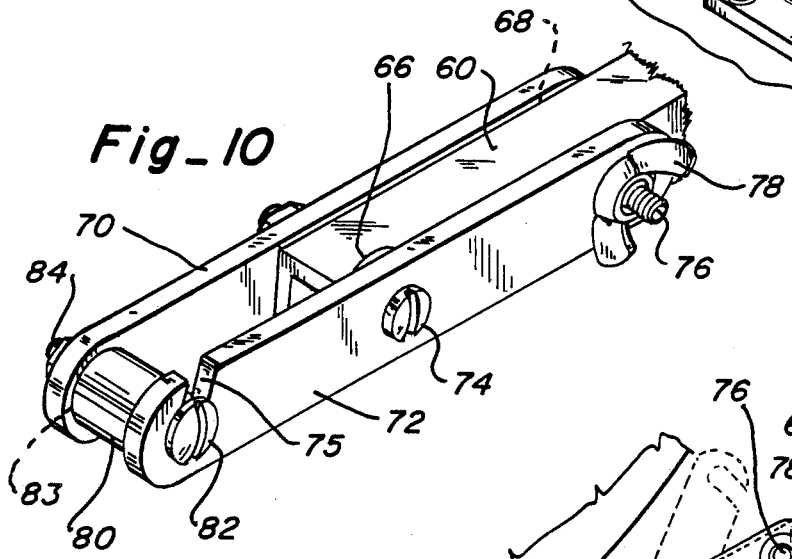
FIG. 10 is an isometric view of the bow leg clamp.
Figure 11:
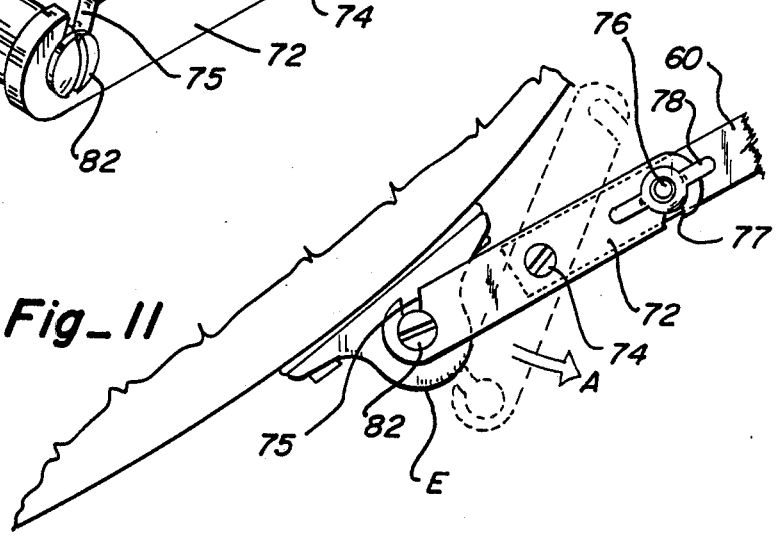
FIG. 11 is a side pictorial view showing the attachment of the bow leg clamp to the bow eye of the boat.

The lower end of leg 18 is secured to the bow eye of the boat by means of a swivel plate connector 64. This connector is illustrated in FIGS. 10 and 11 and includes a pair of aligned holes 66 positioned in the end of leg member 60. A second pair of aligned holes 68 are also provided spaced inwardly on the member 60 from the first pair of holes 66. A pair of elongated flat connector plates 70, 72 are mounted on each side of the leg member 60. These plates are held in position by centrally positioned drilled holes and a bolt assembly inserted through parallel holes 66. Suitable washers (not shown) can be provided between the plates 70, 72 and the leg members 60. This washer is especially desirable between plate 72 and the leg member 60 to allow the plate 72 to pivot freely to provide the connecting function. The plates 70, 72 also have identically positioned holes near their outer ends. In addition to these holes the plate 72 includes curved slots 75, 77 provided in conjunction with the holes and which have the same width as the holes. A bolt 76 is threaded as shown in FIG. 10 through the holes provided in the upper ends of the plates 70, 72 and through the aligned holes 68 provided in the leg member 60. Wing nut 78 is threaded on the end of bolt 76 to hold the plates in aligned position with respect to the leg member 60. At the opposite end of plate 70 is provided an enlarged cylindrical spacer 80 which is fabricated from a soft material such as brass, aluminum, Nylon or fiber composition. A central threaded bore is provided in the spacer 80 which is sized to fit a round headed bolt 82. The bolt 82 is threaded through the spacer 80 leaving a space between the head of the bolt 82 and the spacer 80 which is slightly greater than the thickness of the member 72. The bolt with the spacer is then inserted through the hole 83 provided in the end of the member 70 and this assembly is fixed in rigid position by a suitable nut 84.

To use the connector and attach the end of the leg 18 to the bow eye E it is merely necessary to loosen the wing nut on the bolt 76 and rotate the connector plate 72 around the center bolt 74 in the direction as shown by the arrow A. Because of the slots 75, 77 the plate 72 is capable of being pivoted so as to expose or free the head end of the bolt 82 and the spacer 80. Thus, exposed the bolt 82 and spacer can be inserted through the hole provided in the bow eye E. Once the spacer 80 has passed through the opening in the bow eye the plate 72 can be pivoted in the reverse direction so as to align the ends of the plate with the bolts 82, 76. In this position, the wing nut 78 can be retightened so as to hold the plate 72 behind the head of the bolt 82 to securely hold the end of the leg 18 in connection with the bow eye E. This arrangement provides a very simple and easy way of securely connecting the support leg 18 to prevent it from becoming accidentally disconnected from the boat.

Referring back to FIG. 6, the support arms 14, 16 are each made up of a pair of hollow tubular members 86, 88, and 90, 92, respectively. These members are sized to slidably fit one within the other to form a telescoping arrangement. Thus, the length of each arm can be varied or adjusted to custom fit the particular boat upon which the mount will be used by drilling holes through the overlapping sections of the members 86, 88, and 90, 92. These sections are then rigidly held together by suitable fasteners such as bolts and nuts. If desired, as explained with respect to the support leg 18, it is also possible to provide a number of spaced aligned holes in the inner members 88 and 92 with a releasable pin inserted through an aligned pair of holes in the ends of members 86, 90. In this way, the length of the individual arms can be adjusted so that the mount can be used on various boats when desired. Although it has been shown that square tubular members are used to fabricate the arms 14, 16, it is also feasible to make these members from tubular material having circular or rectangular cross section. In addition, it is also feasible that the inner members 88, 92 can be solid if the weight of the overall assembly is not a problem.

Figure 9:
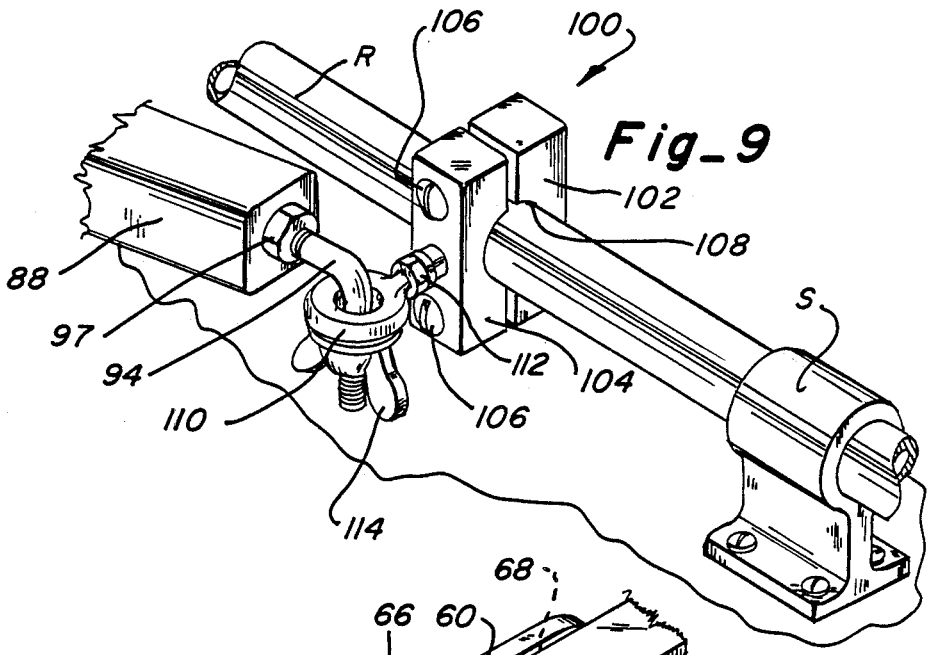
FIG. 9 is a partial pictorial view of the connection between the bow rail clamp and bracket arm.

As an additional feature of this invention a quick disconnect, flexible type joint is provided to connect the ends of the arms to the boat as seen in FIGS. 6 and 9. Most pleasure boats are provided with bow rails R which are provided around both sides of the deck D. The difference lies in the fact that the rails have different shapes, different positions or are of different size. This invention can make use of any and all common bow rails R which are provided. In the infrequent situation where bow rails are not provided, it is possible to provide a pair of short tubular rails having circular cross section which can be suitably mounted on the deck by means of stanchions S. Thus, short rail sections can be permanently mounted on the deck and can be used in mounting or in supporting the motor mount according to the present invention.

The quick disconnect type arm joint includes a pair of L-shaped bolts 94, 96 which are threaded on each end. One end of each bolt is threadedly inserted into holes provided in the outer ends of arm members 88 and 92. A lock nut can be mounted on the threaded sections which are inserted into the ends of the arms so as to lock against the end of the arm and thus hold the L-bolts 94, 96 in proper position.

A split block type clamp 100 is formed from a pair of rectangular blocks 102, 104 which are held together by suitable screws 106 and nuts (not shown). The screws 106 pass through bores larger than the diameter of the screws in the first block 104 and into like bores provided in the second block 102 and are fastened with a nut. In this way, the two halves 102, 104 can be held together to hold the clamp in proper position. A large circular hole 108 is drilled laterally and centrally through the blocks 102, 104. Enlarged hole 108 is intended to have a diameter which is slightly larger than the diameter of the largest bow rail that is anticipated. In addition, the blocks while being drilled are held in a spaced relationship so that when the blocks 102, 104 are positioned on the bow rail R the screws 106 can be tightened so as to clamp the blocks 102, 104 securely on the outer surface of the rail at any desired position. In this way, most any size of bow rail can be accommodated.

A threaded eye bolt 110 having a suitable lock nut 112 is positioned in a threaded bore provided in the outer surface of the first block 104. By the use of the lock nut 112 the eye bolt 110 can be threaded into the block 104 as far as desired and then locked firmly in the position desired. In this way, the eye bolt 110, L-bolts 94 and 96 and split type clamp 100 can all be rotated in any direction to accommodate any configuration desired. To secure the ends of the arms 14, 16, the ends of the L-bolts 94 and 96 are inserted through the eye bolts 110 and the ends are then secured by lock washers and wing nuts 114 to hold them in place.

It is also possible to provide a plastic or synthetic material insert in the opening of the eye bolt 110 to cushion and quiet the connections between the arms 14, 16 and bow rails R.

If desired, it is also possible to attach a threaded spacer 115 such as by welding to the upper surface of either or both of the arm members to provide a support or rest for the mounting plate 30 which can be pivotally moved into position over the arm. A recessed slot 116 and suitable bolt 118 can be provided for securing the mounting plate 30 to the spacer 115. In this way, the mounting plate can be securely fastened into position so that it will not pivot during actual use of the trolling motor.

In use, the mounting bracket of the trolling motor is attached to the mounting plate 30 by properly drilling the mounting plate to correspond to the mounting holes provided in the motor bracket. With the motor base bracket securely attached to the mounting plate, the mounting plate 30 can be freely pivoted to the right or left as desired. The mounting plate can be left free to rotate during operation or as mentioned above, it can be secured to the threaded spacers 115 on one or both of the support arms. In most cases, the length of the mounting plate 30 and the slot 116 will be arranged so that they will be shorter than the total length of the arm members 86 or 90 to prevent interference with the inner telescoping portions 88, 92.

Although the materials used throughout this invention are not critical to the actual operation, it is important to use the type of materials which are essentially noncorrosive when subjected to a water environment. This is especially true if the boat and the subject motor mount are intended to be used in a salt water environment. For this purpose, stainless steel, anodized aluminum or brass should be used for manufacturing the various parts of the invention, or if desired, synthetic materials such as plastics or reinforced fiberglass could be substituted.

Although an electric trolling motor has been illustrated and discussed in this application, it is also possible that a gasoline powered trolling motor having suitable controls could be used with the present invention provided a suitable adapter is mounted on the mounting plate of the present invention. In either use the present invention will provide the desired engine support and function.

While a trolling motor mount has been shown and described in detail in this application, it is to be understood that this invention is not to be considered limited to the exact form disclosed and changes in the detail and construction of the motor mount may be made without departing from the spirit thereof.

What is claimed is:

1. A trolling motor mount for pleasure boats, said motor mount being capable of being quickly installed and removed from the boat so that the boat can be converted for fishing purposes, the motor mount comprising:

(a) a base plate means;

(b) an elongated mounting plate pivotally mounted near one end on said base plate means, said mounting plate being arranged to receive a mounting assembly of a trolling motor for propelling and maneuvering the boat at slow speeds;

(c) a pair of support arm means each attached at one end to the boat deck in a spaced relation to each other and the opposite ends each pivotally connected to the base plate means so that they can rotate in a plane parallel to the base plate means; and (d) a support leg means attached at one end to the bow of the boat and the opposite end pivotally connected to a clevis means attached to the base plate means so that the support leg means rotates in a plane perpendicular to the base plate means, said perpendicular plane being aligned substantially along the longitudinal axis of the boat.

2. A trolling motor mount as defined in claim 1 wherein a low friction spacer means is positioned between said base plate means and said mounting plate to reduce the friction between these parts when said mounting plate is pivoted with respect to said base plate means.

3. A trolling motor mount as defined in claim 1 wherein said support arm means and support leg means each include a pair of end members arranged to telescopically interfit with each other whereby the overall length of each of the arm means and support leg means can be varied in length to accommodate a pleasure boat.

4. A trolling motor mount as defined in claim 3 wherein the telescoping end members include means for releasably fastening the arm and leg members in position with respect to each other so that the length of the arms and legs can be adjustably varied as desired.

5. A trolling motor mount as defined in claim 1 wherein each of said support arm means includes a quick coupling means for attaching the respective end of the arm to the boat deck.

6. A trolling motor mount as defined in claim 5 wherein the pleasure boat has bow rails and the quick coupling means for the support arm means includes a slidable clamp means which can be attached to the bow rail of the boat so that the end of the support arm means can be quick coupled to the clamp means in order to install and remove said trolling motor mount.

7. A trolling motor mount as defined in claim 1 wherein the boat includes a bow eye and the end of the support leg means which attaches to the bow of the boat includes a quick disconnect means for attaching the end of the support leg means to the bow eye of the boat.

8. A trolling motor mount as defined in claim 7 wherein the quick disconnect means at one end of said support leg means for attachment to the bow eye of the boat includes a pivotal latch plate mounted on the side of said support arm means and a cylindrical spacer suspended beyond the end of the support leg means whereby as the plate is pivoted the spacer can be inserted into the bow eye of said boat and locked in position by returning the pivoted plate to its original position with respect to said support leg means.

9. A trolling motor mount as defined in claim 1 wherein said mounting plate is an elongated flat plate which is pivoted near one end to said base plate means.

10. A trolling motor mount as defined in claim 9 wherein said mounting plate includes a longitudinal slot provided in the end opposite the pivotal mounting end, and at least one of said support arm means includes a threaded spacer mounted thereon and arranged so that a fastener means can be positioned in said slot and attached to said spacer to rigidly fix said mounting plate means with respect to said support arm means.

11. A portable trolling motor mount for pleasure boats, said mount being capable of being quickly and easily installed or removed from a pleasure boat having bow rails and a bow eye, said trolling motor mount comprising:

(a) a base plate means;

(b) an elongated mounting plate sized to receive the mounting support bracket for an electric trolling motor, said elongated mounting plate being pivotally mounted near one end on said base plate means;

(c) a pair of support arm means each having a pair of telescoping tubular members which are attached at one end to a quick coupling means attached to the bow rail of said boat and the opposite end pivotally attached to the base plate means so that it can rotate in a plane parallel to the base plate means; and (d) a support leg means including a pair of telescoping tubular members which are arranged to adjust the length of said support leg means, one end of said support leg means including a quick disconnect means for attachment to the bow eye of the boat and the opposite end being pivotally attached to a clevis means attached to the base plate means so as to rotate in a plane perpendicular to the base plate means whereby the electric trolling motor mount is positioned beyond the end of the bow of the boat so that the trolling motor can be properly positioned in the water for propelling and moving the boat, said perpendicular plane being aligned substantially along the longitudinal axis of the boat.

12. A portable trolling motor mount as defined in claim 11 wherein a low friction spacer means is provided between said base plate means and said mounting plate means to allow the mounting plate means to rotate with said trolling motor to any desirable position with respect to said base plate means.

* * * * *